United States Patent [19]

Gaviorno, Jr.

[11] 4,212,371

[45] Jul. 15, 1980

[54] LADDER ATTACHMENT

[76] Inventor: Alexander R. Gaviorno, Jr., 57 Devonshire Dr., Cheshire, Mass. 01225

[21] Appl. No.: 33,139

[22] Filed: Apr. 25, 1979

[51] Int. Cl.[2] ..... E06C 7/14

[52] U.S. Cl. ..... 182/121; 248/238

[58] Field of Search ..... 182/121, 122, 120, 214, 182/117; 248/238, 210

[56] References Cited

U.S. PATENT DOCUMENTS

| | | | |
|---|---|---|---|
| 441,722 | 12/1890 | Vassall | 182/121 |
| 686,159 | 11/1901 | Sprague | 182/121 |
| 1,155,125 | 9/1915 | Blankenhagen | 182/121 |
| 1,710,026 | 4/1929 | McCormick | 182/121 |

FOREIGN PATENT DOCUMENTS

| | | | |
|---|---|---|---|
| 493618 | 3/1930 | Fed. Rep. of Germany | 248/238 |

*Primary Examiner*—Reinaldo P. Machado

*Attorney, Agent, or Firm*—Mark T. Basseches; Paula T. Basseches

[57] ABSTRACT

The present invention relates to a foldable ladder attachment adapted to be secured to the rungs of a ladder to provide a platform for paint cans, brushes or like appurtenances or tools. The device is characterized by a novel linkage assembly enabling the apparatus to be readily accommodated to be affixed at an acute or an obtuse angle to a straight or extension ladder or inside or outside the sections of a folding ladder, without necessitating the employment of extensible stretcher mechanisms or like cumbersome devices as embodied in scaffold or platform supports heretofore known.

7 Claims, 3 Drawing Figures

LADDER ATTACHMENT

BACKGROUND OF THE INVENTION

1. Field of the Invention

The present invention is in the field of support platforms or scaffolds and pertains more particularly to an improved platform device which may be readily folded for storage or portability and erected and mounted in a variety of positions on a ladder.

2. The Prior Art

Numerous devices in the nature of ladder attachments are known, which devices are intended to be readily mounted to and demounted from ladders to provide shelf space accessible at a selected position thereon. Such devices have typically included a shelf or platform, hook means engageable with rungs of the ladder and extensible stretcher arms defining a brace spanning the distance between a portion of the platform remote from the ladder and a brace assembly engaged against and extending along the length of the ladder.

Such known devices have included a plurality of connection points disposed longitudinally of the brace whereby the stretcher may be adjustably connected to the brace so that the platform lies at a desired angle relative to the ladder.

Devices of the type described heretofore known have been bulky and incorporated a multiplicity of parts which must be relatively adjusted before the desired postitioning of the platform is attained. Moreover, the platform supporting struts in such known devices have either required an adjustment mechanism to accommodate them to the varying spans presented by particular attachment arrangements or have required that the angle defined between the struts and platform vary widely in accordance with the angular relationship of the platform to the ladder.

More particularly, where the platform was intended to be disposed against an inner leg of an "A" type ladder so as to lie between the legs of the ladder (hereinafter an inside connection) defining an included angle greater than 90° between the undersurface of the ladder leg to the undersurface of the platform, the angle between the support struts and platform became very small. Accordingly, the weight which might be supported by a platform thus applied was quite limited since the point of connection between the support struts and brace lay in relative close proximity to the connection between the platform and the rungs of the ladder.

Where the devices were attached such that an acute angle was included between the undersurface of the platform and the leg of the ladder (hereinafter an outside connection), the angle between the struts and platform was increased and connection between the struts and brace effected at a distance widely displaced from the connection between the platform and the rungs.

As will be readily appreciated from the foregoing discussion, such devices required the braces to be of substantial length if both inside and outside connections were to be accomplished, making the device bulky, heavy and cumbersome to transport from job to job.

SUMMARY

The present invention is directed to a platform device adapted to be secured by an inside or an outside connection to a ladder. The device is characterized by a novel linkage assembly interposed between the platform and the support struts which enables the point of connection between the support struts and the brace to be maintained within a relatively small range of distances from the connection of the platform to the ladder rungs, whereby only a relatively short brace need be employed. The angle defined between the support struts and platform may be maintained within a relatively small range, allowing the platform to be efficiently supported. The linkage arrangement is such as to provide a compact platform attachment for ladders, suitable for inside or outside coupling to the ladder, which is inexpensive to fabricate, durable, compact, stable and readily connected to a ladder.

It is, accordingly, an object of the invention to provide an improved portable assembly which enables a support platform to be positioned either inside or outside a ladder.

A further object of the invention is the provision of an attachment of the type described which is compact, has a minimum of moving parts, and may be readily folded for storage or transportation and erected and attached for use.

To attain these objects and such further objects as may appear herein or be hereinafter pointed out, reference is made to the accompanying drawings, forming a part hereof, in which.

Figure 1:
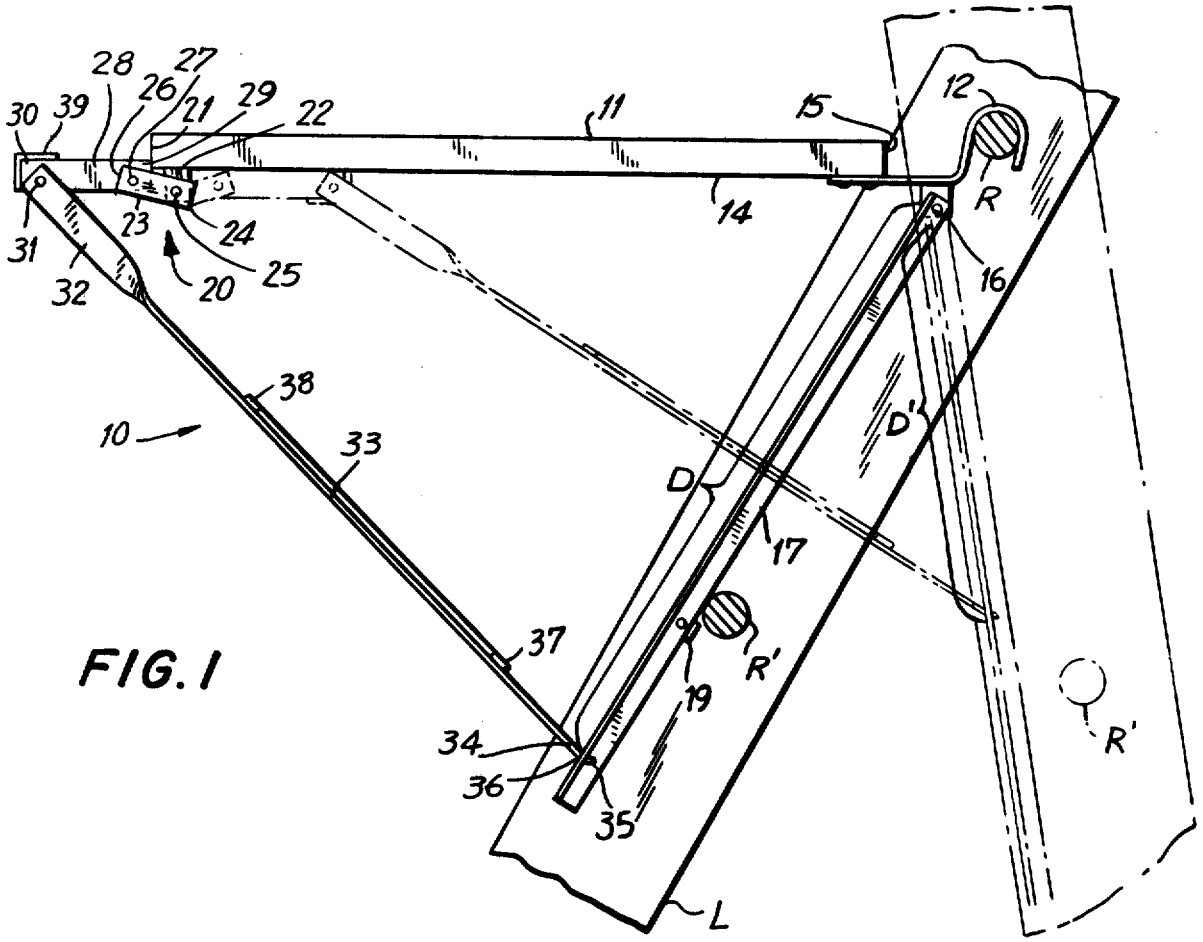
FIG. 1 is a side elevational view, partially in section, showing a ladder attachment of the type described positioned in both inside and outside attachment orientations.

In accordance with the invention, the apparatus 10 includes a platform 11 which may be fabricated of plywood, metal or like rigid material in combination with a foldable linkage assembly enabling the platform to be secured by attachment to the rungs of a ladder L, such that the platform component 11 is disposed in a substantially horizontal orientation and is thus able to carry paint cans, tools or like articles at a position convenient to the person using the ladder.

The device includes a spaced pair of attachment hook members 12, 12' fixedly secured, respectively, at 13, 13' to the undersurface 14 of the platform 11 adjacent the front edge 15 thereof.

To each of the hook members 12, 12' there is pivotally connected at points 16, 16' hanger arms 17, 17'. The hanger arms 17, 17' are elongated to a degree sufficient to enable them to span at least the distance between two vertically offset rungs R, R' of a ladder.

Each of the hanger arms or braces 17, 17' includes a plurality of longitudinally spaced-apart apertures 18 defining connector points, for purposes which will appear more clearly from the ensuing description.

The hanger arms 17, 17' are maintained in spaced parallel relation by a cross brace 19 extending between the arms at a position displaced from the points of connection 16, 16' of the arms to the hook members.

As best seen in FIG. 1, the platform 11 includes a mounting linkage 20 fixed to the platform 11 adjacent the rear edge 21 thereof. Two such linkage assemblies are provided, and since the assemblies are identical, a description of one will suffice.

Each linkage assembly includes a pivot bracket 22 affixed to and depending from the undersurface 14 of the platform. A connector link 23 is pivotally secured adjacent a first end 24 thereof to the pivot bracket 22 as by a pivot pin or rivet 25. A second end 26 of the connector linkage 23 is pivotally connected at 27 to a lock bar 28 adjacent an end 29 of the bar. The other end 30 of the lock bar is secured to pivot pin 31 to an end 32 of a stretcher leg 33, two identical such stretcher legs being provided.

The stretcher legs 33 include adjacent their free ends 34 a lock pin 35 sized to enter into the receiver apertures 18 of the hanger arms. Enlarged stop portions 36 are formed on the stretcher legs 33 rearwardly of the lock pins 35 so that the pins may enter into the apertures 18 to a limited extent only.

A pair of scissors braces 37, 38 are secured between the spaced stretcher legs 33 in criss-cross fashion, serving to maintain the legs in spaced parallel relation corresponding to the spacing of the hanger arms 17, 17'.

A carrier handle 39 is secured, as by welding, between the ends 30 of the lock bars 28.

Figure 3:
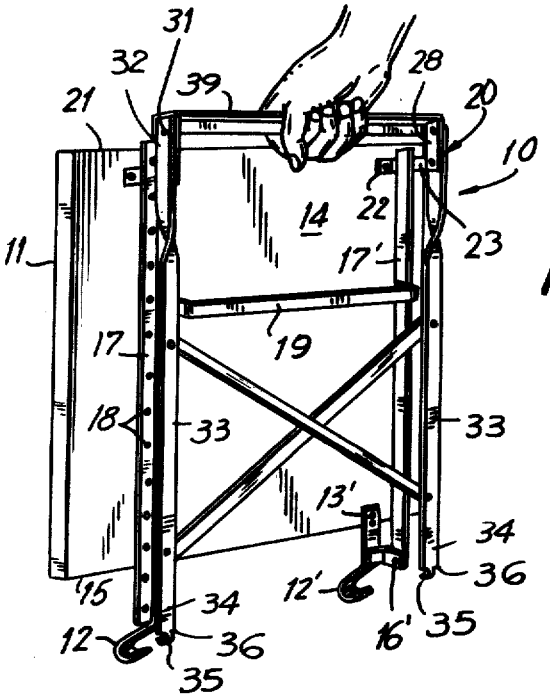
FIG. 3 is a perspective view of the attachment apparatus folded for transportation or storage.
Figure 2:
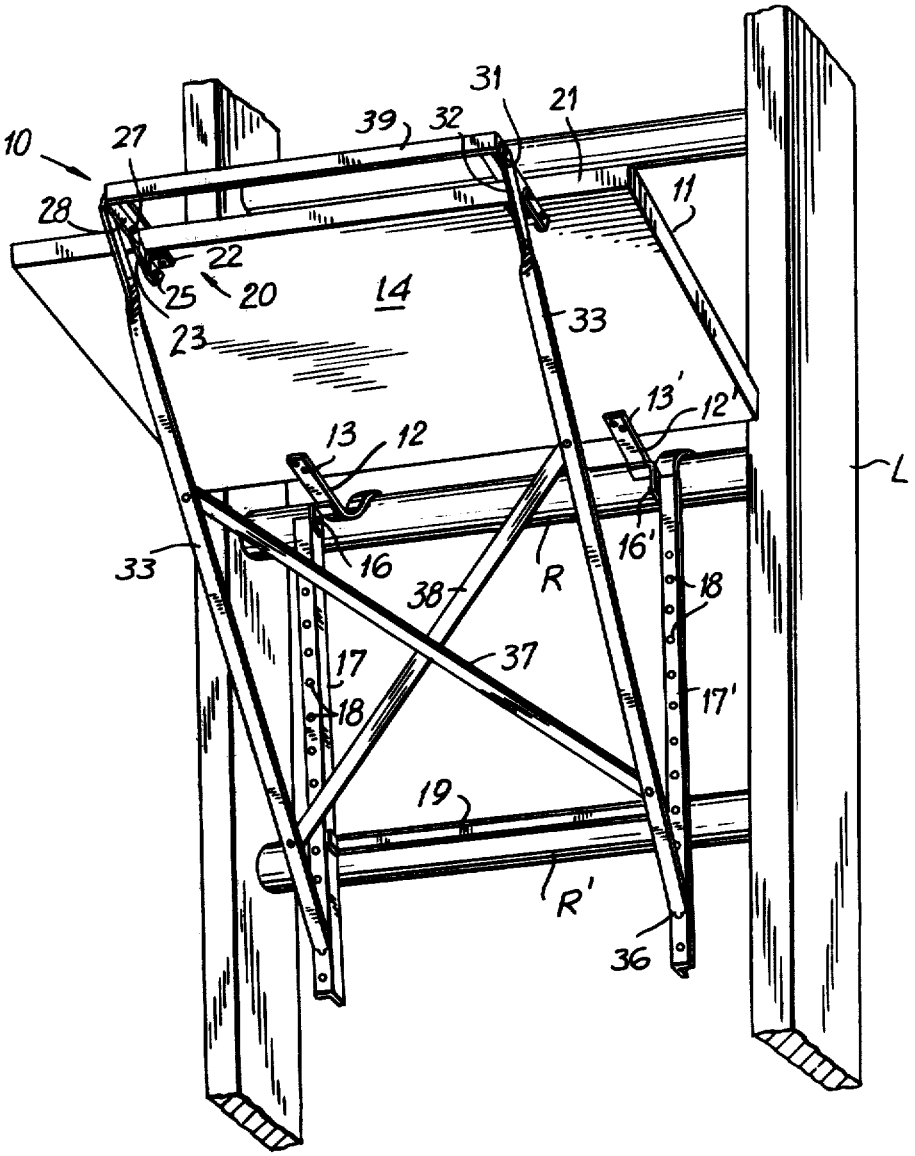
FIG. 2 is a perspective view from underneath showing a ladder having an attachment in accordance with the invention secured thereto.

The ladder attachment is shown in FIG. 3 in its collapsed position where the hanger arms 17, 17' are folded against the undersurface 14 of the platform and the stretcher legs 33 are likewise folded flatwise. In such orientation, the carrier handle may be used conveniently to transport the attachment.

Referring now particularly to FIG. 1, the device is shown attached to a ladder in the inside position (dot and dash lines) and the outside position (solid lines).

To effect such attachment, and referring particularly to the solid line or outside position, the parts are unhinged from the flatwise folded condition of FIG. 3 and the hook members 12, 12' are disposed over rung R at a heightwise position convenient to the user. The hanger arms 17, 17' are thereupon pivoted so as to lie against the nearest lower rung R', whereby the hanger arms define a brace constrained to lie parallel to the ladder.

Next, the linkage 20 is folded so that the connector link and lock bar are disposed outwardly beyond the rear edge 21 of the platform (solid lines, FIG. 1) and the locking pins 35 are inserted into apertures 18 in the hanger arms 17, 17', the specific apertures being selected to achieve as near a horizontal disposition of the platform 11 as is possible.

In the assembled position described, the end 29 of the lock bars 28 preferably butt against the rear edge 21 of the platform and, thus, any downward pressures exerted against the platform, such as would be exerted by the weight of material disposed on the platform, is resisted by engagement of the lock bars against the rear edge 21 and the locking engagement of pins 35 in apertures 18.

Where it is desired to secure the attachment to a ladder in the inside orientation (dot and dash lines, FIG. 1), the linkage 20 is swung inwardly such that the connector link and the lock bar are disposed beneath the undersurface 14 of the platform. Once again the pins 35 are inserted within appropriate apertures 18 such as to maintain the platform in an essentially horizontal orientation.

With the attachment affixed in the inside position, it will be observed that downward pressures against the platform will induce a reacting force through the stretcher legs, tending to urge the pivot pin 31 outwardly toward the hanger bracket 22. As will be observed from FIG. 1, the pivot pin connection 25 between the connector link and the attachment bracket is disposed at a level below the pivot pin 27, securing the other end of the connector link to the lock bar. In view of this disposition of the parts, the outward reactive force exerted against the linkage assembly by the stretcher legs 33 will tend to force the connector link upwardly, pressing the lock bar 28 against the undersurface 14 of the platform, whereby a stable condition of the platform is assured.

As will be apparent from comparing the positions of the parts when the attachment is secured in an inside and an outside orientation, the angular relationship of the stretcher legs 33 relative to the platform remains generally similar.

Likewise, the distance D between the point of connection of the pins 35 from the pivot 16 in the outside connection configuration is not widely displaced from the distance D' between such components in the inside connection position.

The importance of this aspect of the device is best understood by comparing the instant construction with the devices of the prior art wherein a pivotal connection is effected directly between a strut and the undersurface of the platform. Under such circumstances, it will be observed that to effect an outside connection, the connector ends of the strut would join the brace engaging the ladder at a position well below the position shown in the illustrated embodiment and it would be necessary for the brace to be substantailly elongated.

Conversely, and again assuming a direct connection between the strut and the platform, an inside connection between the noted parts would require the strut ends to engage against the brace at points closely adjacent the pivot point 16, in which latter orientation the struts define a very small acute angle with the platform. It will be readily recognized that the existence of such acute angle subjects the strut to substantial buckling force vectors as a result of application of weight to the platform.

By providing a linkage assembly as shown wherein the ends of the stretcher legs are located outwardly beyond the rear edge of the platform where an outside connection is effected, and are disposed beneath the platform where an inside connection is effected, the instant device enables the provision of short hanger arms or braces and avoids a condition in which undue compressive forces are applied to the stretcher legs when the device is assembled at an inside retained configuration.

It will thus be observed that the device of the present invention provides an improved ladder attachment assembly which is readily adaptable for both inside and outside connection to ladders and which may be simply construed of inexpensive parts. The device may be easily collapsed for storage or transportation, and rapidly erected for use.

Variations in details of construction may occur to those skilled in the art who are apprised of the instant disclosure without departing from the spirit of the invention. Accordingly, the invention is to be broadly construed within the scope of the appended claims, and is readily adapted for use with ladders of any type in which the rungs can be encompassed by the hooks, i.e. straight ladders, extension ladders, folding ladders and the like.

Having thus described the invention and illustrated its use, what is claimed as new and is desired to be secured by Letters Patent is:

1. A foldable platform attachment for a ladder comprising a rigid, generally rectangular carrier platform having front, rear and side edges, said platform including adjacent each of its side edges a foldable linkage arrangement adapted to assume a triangular configuration, each said linkage arrangement including a hook member fixed to said platform adjacent its front edge and adapted to be engaged over a ladder rung, a hanger arm pivotally depending from said hook member for movement about a first pivot axis parallel to the plane of said platform, said hanger arm being adapted to engage against adjacent ladder rungs and including a plurality of longitudinally spaced lock apertures, a lock bar having a free end and having a second end connected to said platform adjacent said rear edge for pivotal movement about a second axis parallel to said first axis between first and second limiting abutting positions against said platform, said bar extending beyond said rear edge of said platform in one said limiting position and beneath said platform in said other limiting position, and a stretcher leg having one end pivotally connected to said free end of said lock bar for movement about a third pivot axis parallel to said other pivot axes, said stretcher leg including at its other end a connector portion complemental to and adapted to engage a selected lock aperture of said hanger arm.

2. An attachment in accordance with claim 1 wherein each said linkage arrangement include a connector link having a first end pivotally connected to said second end of said lock bar and a second end pivotally connected to said platform, the pivotal connections to said connector linkages being parallel to said other pivot axes.

3. An attachment in accordance with claim 2 wherein the pivotal connection between said second end of said connector link and said platform is spaced beneath said platform a distance greater than the spacing of the pivot axis connecting said first end of said connector link and said lock bar when said lock bar is in said other limiting position, whereby forces of said stretcher leg reacting against said lock bar urge said connector link toward said platform.

4. An attachment in accordance with claim 1 wherein said second end of said lock bar is in abutting engagement against said rear edge of said platform when said lock bar is in said one limiting position.

5. Apparatus in accordance with claim 4 and including cross braces extending between said stretcher legs of said linkage arrangements, thereby to maintain said linkages in parallel spaced relation.

6. An attachment in accordance with claim 1 and including a cross bar member extending between and connecting said foldable linkages and maintaining the same in parallel spaced relation.

7. An attachment in accordance with claim 6 wherein said cross bar extends between the lock bar portions of said linkages.

* * * * *